United States Patent [19]

Linda et al.

[11] Patent Number: 4,796,808

[45] Date of Patent: Jan. 10, 1989

[54] TRUCK BUMPER MOUNTABLE WATER SWEEPER

[76] Inventors: John W. Linda; Anthony Matracia, both of 7615 Granite Ave., Orangevale, Calif. 95662

[21] Appl. No.: 177,918

[22] Filed: Mar. 14, 1988

[51] Int. Cl.[4] ..... B05B 9/00

[52] U.S. Cl. ..... 239/175; 239/587

[58] Field of Search ..... 239/162, 164, 170, 172, 239/176, 754, 587, 175

[56] References Cited

U.S. PATENT DOCUMENTS

| | | | |
|---|---|---|---|
| 2,044,039 | 6/1936 | Woodcock | 239/172 |
| 2,995,307 | 8/1961 | McMahon | 239/161 |
| 3,599,722 | 8/1971 | Davidson et al. | 239/587 |
| 3,690,559 | 9/1972 | Rudloff | 239/754 |
| 3,726,481 | 4/1973 | Foster et al. | 239/175 |
| 3,987,964 | 10/1976 | Pittman et al. | 239/754 |
| 4,039,147 | 8/1977 | Hugg | 239/172 |
| 4,271,617 | 6/1981 | Yoshizawa | 239/754 |
| 4,315,602 | 2/1982 | Kubacak et al. | 239/587 |
| 4,722,324 | 2/1988 | Amen | 239/176 |
| 4,736,888 | 4/1988 | Fasnacht | 239/175 |

*Primary Examiner*—Andres Kashnikow
*Assistant Examiner*—Michael J. Forman
*Attorney, Agent, or Firm*—Mark C. Jacobs

[57] ABSTRACT

A street, sidewalk and gutter water sweeping apparatus that mounts to the front bumper of trucks as small as a pickup. The apparatus is actuated and the sprayhead directionally controlled from inside the truck cab. The sprayhead is positioned such as to permit water to easily flow beneath any parked vehicle interposed between the sweeper and the sidewalk. The apparatus is moveable from a first stowed position to a second operative position.

14 Claims, 3 Drawing Sheets

TRUCK BUMPER MOUNTABLE WATER SWEEPER

KNOWN PRIOR ART

As the result of a patent search, the following patents are known to the inventor:

| | |
|---|---|
| 0,502,768 | Schreick |
| 2,044,039 | Woodcock |
| 2,116,935 | Richard |
| 3,047,240 | Lent |
| 3,111,268 | Butler |
| 3,121,535 | Schneider |
| 3,726,481 | Foster |
| 3,941,537 | Abraham |
| 4,058,256 | Hobson |
| 4,252,274 | Kubacak |
| 4,586,287 | Bleasdale |

Of the devices that turned up in the search, only Schreick; Woodcock; Butler; Schneider and Kubacak pertain directly to water based cleaning vehicles. Lent's disclosure pertains to an irrigation unit capable of 360 degree rotation, due to its unique construction.

BACKGROUND OF THE INVENTION

Industry is replete with devices that can clean streets. These devices are usually large integrated water tank trucks with spray mechanisms at their front ends. Reference for example is made to the Woodcock patent. One of the problems with spray vehicles of this nature is that the water is delivered from either fixed or movable sprayheads disposed relatively high, such as 3 feet from the street surface. Thus if a vehicle is parked next to the curb, the water flow must be shut off or else water will be sprayed upon the interposed vehicle, much to the consternation of the vehicle owner.

Most water spray vehicles are limited in utility, in that they can only create a spray to clean an area of the street, and not the side walk.

There is a need therefore for a versatile water sweeping device, that can be used to clean streets, sidewalks, and also to apply water to soil prior to compaction.

It is an object therefore of this invention to provide a low cost, easily transported water sweeping apparatus.

It is another object to provide a water sweeping apparatus that can be mounted to the bumper of any truck including pickup trucks.

It is yet another object to provide a water cleaning apparatus that is capable of delivering water beneath parked vehicles.

Still another object is to provide a water sweeping apparatus that can clean the combination of sidewalk, gutter and street in one cleaning operation.

A further object is to provide a water sweeping apparatus which can be placed in a stowed position during periods of transportation.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

For a fuller understanding of the nature and objects of the invention, reference should be had to the following detailed description taken in conjunction with the accompanying drawings.

SUMMARY OF THE INVENTION

A front bumper mountable water sweeping apparatus capable of directing its water beneath parked vehicles. It is adapted to spray anywhere within a 180 degree span. Any conventional tank can be easily connected thereto for dissemination of any fluid, preferably water.

DESCRIPTION OF THE PREFERRED EMBODIMENT

Figure 1:
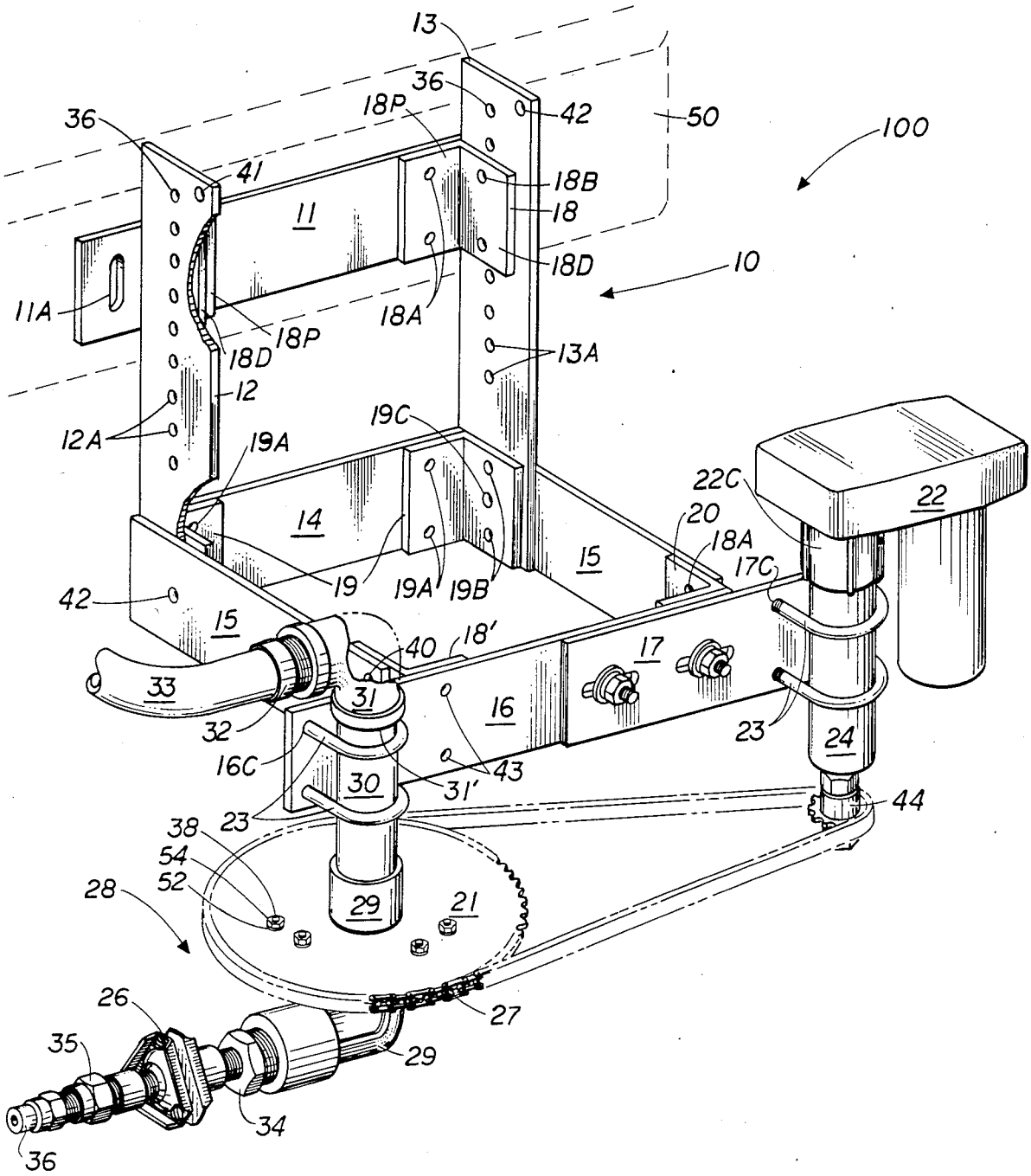
FIG. 1 is a left perspective view of the apparatus of this invention.
Figure 2:
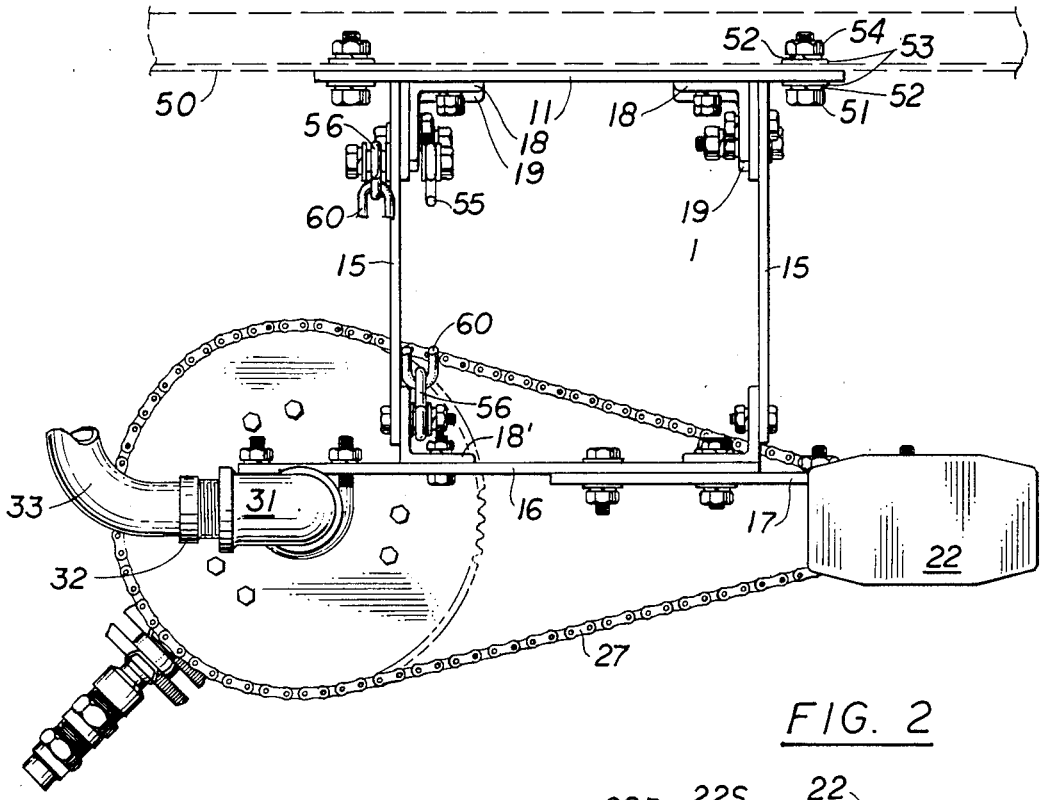
FIG. 2 is a top plan view thereof.

Turning now to FIG. 1, wherein the apparatus according to this invention is depicted. Truck bumper 50 represents the front truck bumper of any typical full size or small size pickup truck such as made by Ford, GM or Chrysler or any of the Japanese truck makers. Truck bumper 50 can also represent the bumper of any tank truck available in the marketplace today from a number of specialty truck makers. To this is secured the apparatus 100 of this invention.

Figure 7:
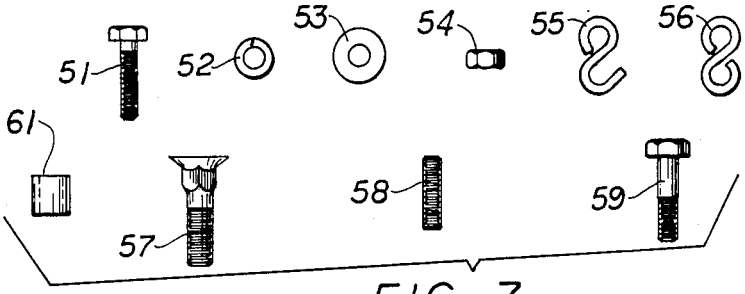
FIG. 7 is a diagrammatic illustration of the connecting hardware employed in the assembly of the instant invention.

In order not to clutter the drawings with small components, all of the hardware pieces used in the assembly and mounting of the apparatus to the bumper 50 are illustrated in FIG. 7. In most instances, only one or perhaps none of the hardware pieces will be shown at that point of utilization, but an accurate description will be given at the appropriate location in the text.

Apparatus 100 includes a superstructure 10, a motor 22, a bushing assembly 24 and a nozzle assembly 28 as well the elements to interconnect these components and to make them operative. The superstructure 10 comprises a main mounting plate 11 which is secured to bumper 50 by a 1.5 inch long hex head bolt, 51, disposed in a suitable hole, not seen, in the bumper 50. The bolt 51, only the end of which is visible in FIG. 1, is inserted through vertical slot 11A, one of which is found at each end of the mounting plate, 11.

A pair of bores -not seen- positioned one above the other are spaced inwardly about 3.5 inches from each of the two ends of the mounting plate 11. A pair of angle brackets 18, having distal and proximal plates are secured thereto from the rear side of the mounting plate 11. Each such bracket has a pair of bores 18A not seen corresponding in cross-section and disposition to the bores in bumper 50 in the proximal plate, 18P i.e. adjacent the bumper 50 such that a pair of countersunk head square neck carriage bolts 57, can be inserted therethrough from the rear of mounting plate 11 and held in place by a lockwasher 53 and hex nut 54. (See FIG. 7) By using this type of carriage bolt 57, the heads thereof will be flush to the rear surface of the mounting plate 11. One of said angle brackets is disposed to face leftwardly and one to face rightwardly, i.e. in opposed positions.

It is understood of course that the assembly of the entire apparatus is to transpire first before the unit is mounted to the bumper 50 in the manner just described.

Each angle bracket 18 also has a pair of bores 18B suitably disposed within its distal plate 18D. A pair of vertical struts 12, 13 each of which has a vertical series 36 of throughbores 12A and 13A. Each series may contain from about 6 to 10 such bores, depending upon the length of the strut. These bores 12A, 13A are used for height adjustment of the sprayhead 35 of the apparatus 100. At least one of the two struts 12, 13 includes a forwardly positioned throughbore 41, 42 which is used for the disposition of the stowage chain per FIG. 5. See infra. Hex head bolts 51 are disposed within each bore 18B and through two of the aligned bores 12A, 13A of the series of bores 36 and are secured in place by lock washers 52, and hex nuts 54. Struts 12, 13 when mounted to the angle brackets 18 abut the mounting plate 11.

A third angle bracket 18' having similar distal and proximal throughbores as previously discussed, is used to connect the left hinge arm 15 to the nozzle support 16. Hinge arm 15 is a generally rectangular member, with a pair of vertically aligned throughbores 40, at its forward end and a single larger diameter through bore 42 at its rear end. The purpose of throughbore 42 which serves as a pivot point will be discussed below. Two hex head bolts 51 are used with lock washers 52 and hex nuts 54 to secure the third angle bracket 18' to hinge arm 15. Nozzle support 16, which is seen to be connected to both the third angle bracket 18' and fourth angle bracket 20, is a generally rectangular member having a pair of inset vertically aligned throughbores 43. These last will communicate with the proximal throughbores 18B of bracket 18'. Connection of bracket 18' to the hinge arm 15 is by a pair of hex bolts 51 placed through holes 40 in arm 15 and holes 18C (not seen) in bracket 18' and connection of bracket 18' to the nozzle support 16 is by a pair of hex bolts 51 that pass through bores 43 and are secured by nuts 54, and lock washers 52 not shown at this location in FIG. 1 as was mentioned above.

A fourth angle bracket 20, having distal and proximal ends, the latter being disposed generally normal to bumper 50 in FIG. 1 is used to connect the right hinge arm 15. Hex head bolts 51, not shown pass though throughbores 20A in angle bracket 20 and throughbores 40 also not visible in FIG. 1 in the right hinge arm 15 and are secured by lock washers 52 and hex nuts 54.

Figure 8:
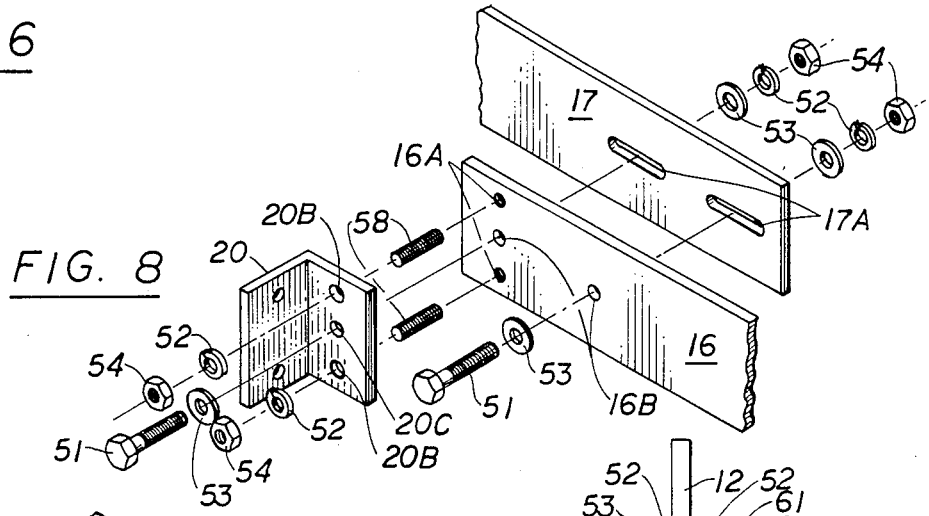
FIG. 8 is a closeup exploded view showing the junction of three elements of this invention.

Angle bracket 20 however, is secured to the nozzle support 16 in a different manner. Reference is made to FIGS. 1 and 8. The distal end of fourth angle bracket 20 has a trio of bores, two of which are 20B, which are similar to bores 18B in angle bracket 18' previously discussed, and a third throughbore 20C interposed and vertically aligned with bores 20B between the two 20B bores. See FIG. 8. Both nozzle support 16 and bushing support 17 are seen in this Figure from the rear or opposite side of that seen in FIG. 1. Since the primary figure for discussion has been FIG. 1, left and right as well as front and rear will be referenced with respect to FIG. 1. Thus in FIG. 8 nozzle support 16 is seen to have a pair of vertically aligned female threaded recesses 16A that are spaced to communicate with throughbores 20B of fourth angle bracket 20; and a throughbore 16B interposed therebetween that communicates with throughbore 20C. Throughbore 16B also communicates with a slot 17A of bushing support 17. Spaced leftwardly of throughbore 16B is a second throughbore 16B, which will communicate with a slot 17A of bushing support 17.

The distal end of fourth angle bracket 20 is secured to nozzle support 16 by a pair of headless bolts 58, which are threaded into female threaded recesses 16A followed by the placement of angled bracket 20, lock washer 52 and a hex nut 54 thereupon. Bolt 51 with plain washer 53 thereupon passes through throughbore 20C, and 16B the latter being in the nozzle support 16, and then through the right slot 17A of bushing support 17. Bolt 51 is secured at the front of bushing support 17 by another flat washer 53, a lockwasher 52 and a hex nut 54. A second such bolt 51 with plain washer 53 attached passes through the solo positioned throughbore 16B and passes through the left slot 17A and is secured in the manner just discussed. Again, see FIG. 8.

Fifth angle brackets 19, seen in FIG. 1 are used to connect the vertical struts 12, 13 to the left and right hinge arms 15. The fifth angle brackets 19 are also connected to lower plate 14. These fifth brackets include a proximal end, that abuts lower plate 14 and a distal end, normal to said lower plate 14. The proximal ends contain a pair of vertically aligned throughbores 19A which communicate with similarly aligned throughbores 14A (not seen) in the generally rectangular bottom plate 14. The proximal end of each plate 19 is secured from the rear side of bottom plate 14 by a pair of countersunk head square neck carriage bolts or the like, 57, which are held in place by lock washers 52 and hex nuts 54.

The distal ends of fifth angle brackets 19 also contain a pair of vertically aligned bores 19B, similar to bores 18B previously discussed. Interposed therebetween is a third bore 19C. Struts 12, 13, each have a pair of vertically aligned female threaded recesses similar to the threaded recesses 16A previously mentioned in the discussion of FIG. 8. These third bores 19C communicate with the pivot hole 42 in each of hinge arms 15. Headless bolts 58 inserted in 12 and 13 secure brackets 19 to each vertical strut 12 and 13 using lock washers 52 and hex nuts 54 per FIG. 9. Two three inch long pivot bolts 59 having plain washer 53 under their heels pass through throughbores 19C, then throughbores 13B or 12B positioned at the lower end of the respective vertical struts, and then through pivot hole 42—this last seen in both FIGS. 1 and 9. Pivot bolts 59 are held in place by a plain washer 53, a hex nut 54, a lock washer 52 and a second hex nut 54. Pivot hole 42 is sized to permit free rotation of the hinge arms 15 with respect to the vertical struts 12, 13. More details on this will be discussed with respect to FIG. 5, which shows the invention 100 in its stowed position.

Figure 9:
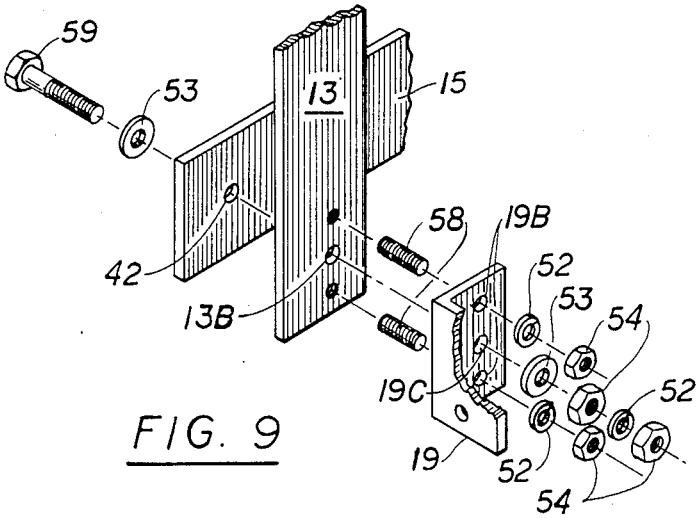
FIG. 9 is a closeup exploded view showing the junction of three other elements of this invention.

While FIG. 9 shows the connections for the vertical strut 13, it is to be understood that the connections for vertical strut 12 are identical.

It is also to be seen that no criticality is to be attached to the use of any combination of plain washers, lock washers and hex nuts. Any other suitable hardware items can be substituted for any and all of these components at each and every location where they are employed.

Mounted at the left end of nozzle support 16 is nozzle assembly 28 while mounted at the right end of bushing support 17 is bushing assembly 24. These are connected by chain 27 as will be discussed infra. Each of nozzle support 16 and bushing support 17 contain at their left and right ends respectively a series of four through-bores 16C and 17C respectively. These are arranged in upper and lower pairs of vertically and horizontally aligned pairs, only two of each quartet being seen in FIG. 1. The nozzle assembly 28, and the bushing assembly 24, are each secured to their respective supports by a pair of U-bolts 23, each of which is preferably ⅜" by 2" I.D. disposed within said bore pairs 16C, 17C, and retained by lock washers 52, and hex nuts 54.

While the bushing assembly 24 is seen to be mounted on the right side of invention 100, with nozzle assembly 28 on the left, no reason is seen why they cannot be mounted in reverse fashion.

Nozzle assembly 28 is seen to comprise elbow 31 which is preferably female threaded at each end. In the lower or vertical end, just below shoulder 31' and threaded into the female threads thereof is the upper end of pipe 30, which is preferably about 1.5"I.D. and about 6" long. The shoulder 31' of the nozzle assembly rests on the top surface of nozzle support 16, while the U-bolts aforementioned, hold the pipe loosely enough in place to permit rotation thereof.

An integrated 1.5" female threaded swivel pipe-elbow 29 is suitably connected to the lower end of pipe 30, as with the use of Teflon brand tape. A reducer 34, to reduce the diameter of the elbow to ¾ or 1", is threadedly engaged in the lower end of threaded pipe-elbow 29. Swivel assembly 26, usually made of brass or bronze, is threadedly engaged to the reducer 34. Swivel assemblies are readily available in the marketplace from such vendors as FMC. The water being sprayed emerges from the tip 36 of the ball joint sprayhead 35. Sprayhead 35 can be manually adjusted by rotation of the ball to change the type of spray that emerges from the sprayhead. Similar adjustments are available on a home garden hose, and therefore more details are deemed extraneous. Suffice it to say that nozzles such as those employed herein are available from Spraying Systems Inc., among others. Reference to FIG. 1, shows that in the operative position for the apparatus of this invention, the nozzle is disposed between two (2) and about six (6) inches off the ground. The adjustment being made by the positioning of the vertical struts 12, 13 relative to brackets 18.

A hose 33 is shown threadedly engaged to the upper end of elbow 31. This hose is connected at its opposite end to a source of water such as a tank (not seen) disposed in the bed of a pickup or other truck. Typically these tanks can hold between 500 and 1000 gallons of water.

Figure 4:
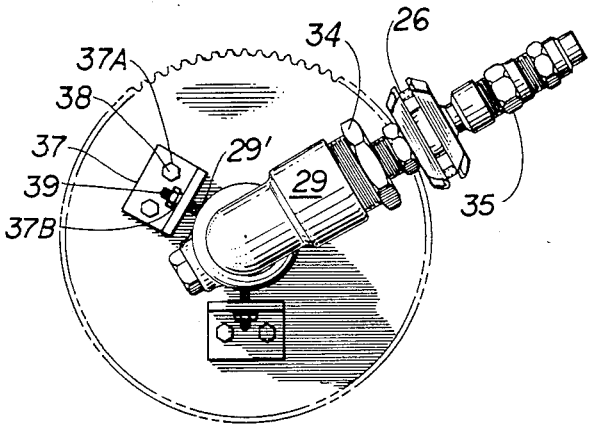
FIG. 4 is a bottom plan closeup view of a portion of the invention.
Figure 5:
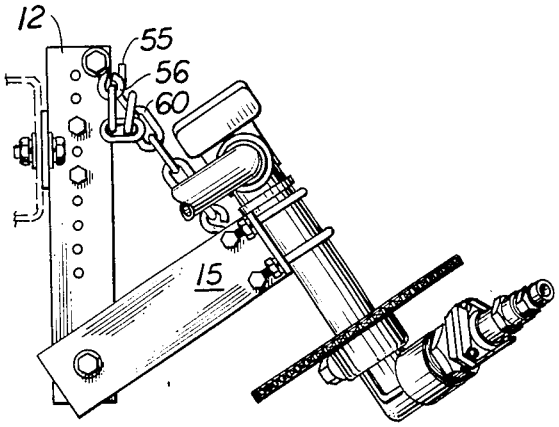
FIG. 5 is a left front perspective view of the apparatus of this invention in the stowed position.

Reference is now made to FIG. 5 and more particularly to FIG. 4. A chain sprocket gear 21, usually of about 10 to 12" in diameter is mounted by a trio of L-brackets 37 having a pair of bores 37A in the horizontally disposed plate thereof. A pair of mounting bolts 38 secures each L-bracket to the sprocket gear 21 through apertures 45 (see FIG. 1). Hex nuts 54 and lock washers 52, retain each bolt 38.

A trio of recesses 29' are tapped into integrated pipe-elbow 29 to threadingly receive headless bolts 39, which bolts pass through bores 37B in the vertical portion of L-brackets 37.

Suitable integrated swivel pipe-elbows 29 are available in the marketplace from Chiksan in the form of its S-30 LP Mall Swivel Joint. Reducer 34 is also available from Chiksan, among others.

Figure 3:
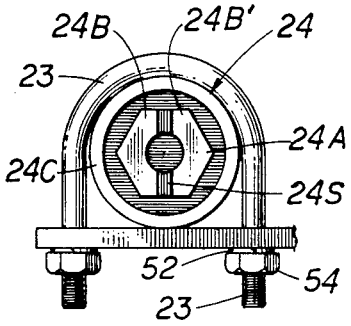
FIG. 3 is a view of the drive shaft with motor removed and inverted to illustrate the mode of connection of each to the other.
Figure 3:
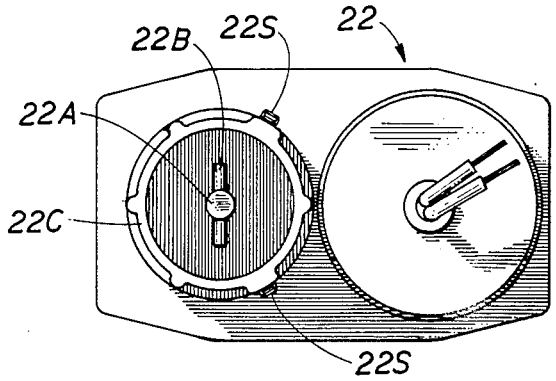

A twelve volt reversible motor and actuator 22, such as the Powerjack, also known as model BUF-16685 made by Burr Engineering Company of Battle Creek Mich. may be employed herewith. Motor and actuator 22 as seen in FIG. 3, include a closed end cylindrical connecting member 22C, which has an internal cross section of about two (2) inches. This member 22C nests over the bushing assembly 24's outer housing 24C, whose outer diameter is about 1.875 inches. This relationship can be better maintained by the use of conventional Allen screws 22S disposed within member 22C, which upon tightening bear upon outer housing 24C. Disposed within connecting member 22C is a rotating shaft 22A having a cross pin 22B disposed normally therethrough and extending equidistantly on opposite sides of said shaft. Detailed discussion on the reduction gearing found inside the motor head are not germane to this invention since such are within the skill of the routineer of the motor art.

The drive shaft 24A of the bushing assembly has at its upper end a split ring top portion 24B, each half being a semiannular portion 24B'. Each portion 24B' is spaced from the other by slot 24S. Slot 24S is sized i.e. the space between the opposed semiannular portions to receive the cross pin 22B. Thus when cross pin 22B is matingly engaged into the slot 24S of drive shaft 24A, power is transferred from the motor and drive to the bushing assembly. It is to be seen that there is no criticality to the mode of connection of the motor and drive 22 to the bushing assembly 24, but rather this is merely exemplary.

Returning now to FIG. 1, it is seen that drive shaft 24A has a chain sprocket gear 44 mounted at or near the lower end thereof mounted on a hub in a conventional manner. This chain sprocket gear is adapted to receive drive chain 27. It is readily seen that while a chain drive employing sprocket gear 44 and sprocket gear 21, which latter may contain for example about 115 teeth, has been disclosed, it is within the scope of the invention to utilize a different gearing arrangement or even a belt drive system instead.

Whichever of the belt drive and chain drive systems is employed, the mode of adjusting the tension or replacing the chain/belt is the same. One loosens the nuts on bolts 51 which bolts pass through the slots 17A of the bushing support 17, and through holes 16B in nozzle support 16 whereby the bushing support 17 can be moved leftwardly toward the nozzle assembly 28 to thereby loosen the tension on the belt/chain, 27. After replacement of the chain 27, or to further tighten the chain should it become loose, the bushing support is moved rightwardly, to the desired location, and the nuts tightened on bolts 51.

Figure 6:
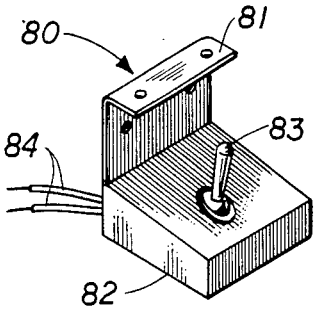
FIG. 6 is a perspective view of the direction controlling means of this invention.

Operative control of this invention is carried out by controller 80 shown in FIG. 6. Controller 80 includes a mounting flange 81 having suitable apertures therein at convenient locations for mounting screws to secure the controller 80 to, under, or even on the top of the truck's dashboard. Housing 82 is attached to the flange 81 by any conventional means. Disposed within the housing 82 is a 180 degree center seeking toggle switch directional controller. A bi-directional joystick that would move from left to right, with the center being no movement could be employed for the purpose at hand. Electrical wires 84 emanating from the housing are for the electrical connections between the truck battery and motor 22.

Figure 10:
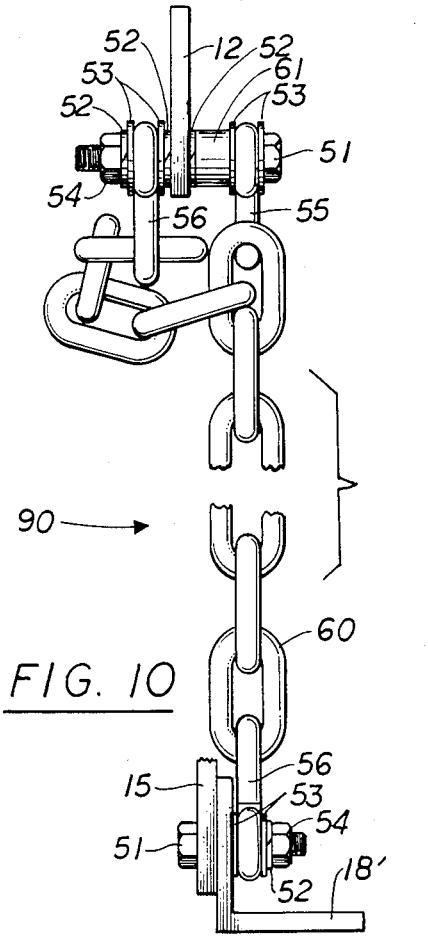
FIG. 10 is a diagrammatic view showing the stowage means of this invention.

In FIG. 5, the apparatus of this invention is seen in the stowed position, such that when attached to a truck, it can be driven from place to place, without scraping the nozzle on the street. While adjustment of the vertical struts relative to the angle brackets to which they are attached is of course possible, such activity is time consuming and not readily accomplished by one person. This type of vertical adjustment is utilized only for special on-site operational needs. For that reason, an optional stowing means, not shown in FIG. 1, in order to avoid clutter, but visible in FIG. 5 and specifically shown in FIG. 10 is recommended.

Stowage means 90 is seen to comprise a bolt 51 on which is mounted an open jaw S-hook 55 a spacer 61 and a first closed jaw S-hook 56. These S-hooks and spacer are conventional hardware parts. This bolt 51 is disposed in either aperture 42 of strut 13 or preferably 41 in vertical strut 12. Aperture 41 is preferred, because a shorter chain may be employed. Chain 60 is secured conventionally to the closed jaw S-hook 56, on one end and to second closed jaw S-hook 56' on the other end. Another bolt 51 is suitably disposed through a pair of communicating throughbores in the distal end of element 15 and the proximal section of element 18'. See FIG. 10. Second closed jaw S-hook 56' is disposed on this second mentioned bolt 51. Lock washers 52 plain washers 53 and nuts 54 retain the respective S-hooks on their bolts.

One merely grabs the chain and places a loop thereof on the open jaw S-hook 55 as shown in FIG. 5 to raise the front of the invention, i.e. supports 16, 17 upwardly relative to plate 14, by causing the hinge arms 15 to pivot on pivot pins 45, which are disposed through pivot holes 42 which communicate with throughbores 19C, previously discussed. Suitable washers and nuts not shown hold the pivot pins 45 in place.

Obviously, this manual stowage system, can be replaced by a more sophisticated motorized pivoting means, the design of which is within the skill of the art, but which will add cost and weight to the apparatus of the invention.

OPERATIONAL USAGE

An apparatus according to this invention was mounted on the front bumper of an American made full size pickup truck. A tank holding between 500 and 1000 gallons of water was suitably disposed within the truck bed. A hose was connected to the apparatus, and after the apparatus was lowered to its operative position, a cleaning test was run on the parking area at the Rollingwood apartment complex in Fair Oaks, Calif. The test was run during the day time, when fewer cars would be parked under the carport areas.

In order to clean the parking lot of debris such as leaves, grass clippings, cigarette butts, dirt and other waste the driver drove slowly straight down the center of the driveway of the apartment complex, and by moving the controller caused the nozzle to rotate from side to side in an almost 180 degree arc thereby causing a sweeping motion in the stream of water coming from the nozzle. While the nozzle can rotate 360 degrees, there was no reason to rotate the nozzle fully for this job. The stream of water extended out about 25 to 30 feet and forced the debris toward the gutter, where due to the planned slope of the ground it could float toward the gutter.

In those areas of the complex where no cars were located, if any debris got up onto the sidewalk, or was there prior to the sweeping, the truck with the apparatus could be driven up onto the curb and a burst of water applied to the debris on the sidewalk. Since this apparatus can be used with pickup trucks, which are relatively lighter in weight, there was no fear of cracking the concrete. This feat is impossible with conventional tank trucks. The entire cleaning operation took between 10 and 15 minutes, and required the services of only the truck driver.

It was found that since the spray nozzle was located in the operative position of the apparatus, only about 6" above the street level, that the water was able to get underneath the parked cars, and that only the tires got wet. This avoided water stains on the car bodies.

Other tests have been carried out in new housing and office projects built in the metropolitan Sacramento, Calif. area. Here the tests were carried out not for grounds maintenance, but to either clean the street and adjacent sidewalk areas, such that the streets could be seal coated by that type of contractor, or to final clean the projects quickly and cheaply to enable the builders to obtain final building inspection such that occupancy could commence.

It is seen that there has been provided a unique apparatus that can be permanently or temporarily if desired, mounted to the front bumper of a pickup or other small truck and used to clean streets and parking lots, without the need to remove parked vehicles as is often required by local ordinance in major metropolitan areas.

Obviously other uses for this apparatus exist, such as to aid in the compaction of soil by the delivery of water to controlled areas prior to the application of pressure thereto.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A truck bumper mountable apparatus for sweeping streets with water, which apparatus comprises:

(a) a superstructure, (b) a bushing assembly, (c) a motor and drive, (d) a nozzle assembly, and (e) linking means operatively connecting said bushing assembly to said nozzle assembly;

said superstructure comprising a pair of spaced vertical struts connected to one another by a pair of spaced normally disposed generally horizontal plates, an upper of which is a mount plate for mounting to a truck bumper and the other of which is a lower plate;

a pair of spaced parallel hinge arms, each of which is pivotally mounted to one of said vertical struts at its proximal end, and each of said hinge arms being connected to the other hinge arm at its distal end, by support means;

said hinge arms being capable of moving from a first upward stowed position to a second lowered operative position;

said bushing assembly having first and second ends, with a motor drive engaging means at its first end and a hub at its second end, said assembly being mounted on said support means;

said motor and drive being a reversible motor and drive mounted on said bushing assembly first end and engaged with bushing assembly;

said nozzle assembly also being mounted on said support means, and having a first end and a second end, with means for connecting a hose from a truck mounted water source at the first end and a sprayhead mounted at the second end thereof, said sprayhead being disposed at a lower elevation than said hinge arms when said hinge arms are in their lower operative position;

means mounted on said nozzle assembly for rotation of said nozzle assembly with respect to said support means;

wherein said linking means controls the rotation of said nozzle means upon actuation of said motor.

2. The apparatus of claim 1 wherein the linking means comprises (a) an endless chain which engages (b) a toothed gear mounted on the hub of said bushing assembly and which also engages a sprocket gear which comprises the means mounted on said nozzle assembly for the rotation thereof.

3. The apparatus of claim 1 wherein the support means comprises a nozzle support, and a bushing support, one of which is connected to both of said hinge arms; one of said supports being mounted in a superposed releasably slidable relationship with respect to the other of said supports.

4. In the apparatus of claim 3 wherein the nozzle support is mounted to the two hinge arms.

5. In the apparatus of claim 4 wherein each support has a proximal and a distal end, and wherein the bushing assembly is secured to the bushing support and the nozzle assembly is mounted to the nozzle support, each at the distal end thereof.

6. The apparatus of claim 1 including control means mountable in a truck cab and electrically connected to said motor for controlling the rotation of said nozzle assembly.

7. The apparatus of claim 1 further including stowage means for raising the hinge arms from their lower operative position to an upper stowed position, and for maintaining the arms in the upper position.

8. The apparatus of claim 7 wherein the stowage means comprises a link chain connected on one end to an upper end of one vertical strut and connected at its other end to the distal end of one hinge arm; and a hook suitably positioned to receive an intermediate link of said link chain.

9. The apparatus of claim 1 further including means for vertically positioning said vertical struts relative to said mount plate.

10. The apparatus of claim 1 wherein the sprayhead includes a ball joint for the angular deflection of said sprayhead.

11. A truck bumper mountable apparatus for sweeping streets with water, which apparatus comprises:

(a) a superstructure, (b) a bushing assembly, (c) a motor and drive, (d) a nozzle assembly, and (e) linking means operatively connecting said bushing assembly to said nozzle assembly;

said superstructure comprising a pair of spaced vertical struts connected to one another by a pair of spaced normally disposed generally horizontal plates, the upper of which is a mount plate for mounting to a truck bumper and the other of which is a lower plate, each of which struts includes means for vertically positioning said strut relative to said mount plate for the connection thereto;

a pair of spaced parallel hinge arms, each of which is pivotally mounted to one of said vertical struts at its proximal end, and each of said hinge arms being connected to the other hinge arm at its distal end, by support means comprising a nozzle support and a bushing support, one of which is connected to both of said hinge arms, and the other of which is releasably slidably connected to the other support;

said hinge arms being capable of moving from a first upward stowed position to a second lowered operative position;

said bushing assembly having first and second ends, with a motor drive engaging means at its first end and a hub at its second end, said assembly being mounted on said bushing support;

said motor and drive being a reversible motor and drive mounted on said bushing assembly first end and engaged with said bushing assembly;

said nozzle assembly being mounted on said nozzle support and having a first end and a second end, with means for connecting a hose from a truck mounted water source at the first end and a sprayhead mounted at the second end thereof, said sprayhead being disposed at a lower elevation than said hinge arms when said hinge arms are in their lower operative position;

means mounted on said nozzle assembly for rotation of said nozzle assembly with respect to said support means;

wherein said linking means controls the rotation of said nozzle means upon actuation of said motor.

12. The apparatus of claim 11 further including means for stowing the hinge arms in an upper stowed position and for retaining the arms in that position.

13. The apparatus of claim 11 wherein the linking means comprises a toothed gear mounted on the hub of said bushing assembly, a chain mounted on said toothed gear, said chain being also mounted on the means mounted on said nozzle assembly for the rotation thereof.

14. The apparatus of claim 11 further including control means for said motor, mountable in a truck cab.

* * * * *